US006167811B1

(12) United States Patent
Walters

(10) Patent No.: US 6,167,811 B1
(45) Date of Patent: Jan. 2, 2001

(54) REVERSE INITIATION DEVICE

(75) Inventor: William P. Walters, Elkton, MD (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 06/930,971

(22) Filed: Nov. 6, 1986

Related U.S. Application Data

(63) Continuation of application No. 06/754,892, filed on Apr. 22, 1985, now abandoned.

(51) Int. Cl.[7] ..... F42B 12/10
(52) U.S. Cl. ..... 102/476; 102/307; 102/309
(58) Field of Search ..... 102/475, 476, 102/305–310, 701

(56) References Cited

U.S. PATENT DOCUMENTS 2,892,407 * 6/1959 MacLeod ..... 102/701 X
3,478,685 * 11/1969 Thomanek et al. ..... 102/306

FOREIGN PATENT DOCUMENTS

1531538 * 7/1968 (FR) ..... 102/476

* cited by examiner

*Primary Examiner*—Harold J. Tudor
(74) *Attorney, Agent, or Firm*—John F. Morgan; Michael C. Sachs

(57) ABSTRACT

A shaped charge explosive device for defeat of advanced armor is presented. In operation, a conically capped hemispherical liner is collapsed in reverse sequence. Detonation of the base of the hemisphere, done earlier in sequence, produces a thick massive jet for initial penetration as a deep crater, in the armor. The conical liner is collapsed afterward, producing a thin jet which reaches the armor deep into the crater earlier produced, at an increased distance than would be usual without a crater. The increased standoff is a further contribution in destructive improvement since adding travel distance to the target for a destructive jet, up to a point, will increase destruction of the target. Various detonation mechanisms, inhibitors, and judicious use of various high explosives and detonation arrangements, all provide the tools for formation of a desired particular two-jet sequence, to accomplish a desired destructive potential. It is further taught that any conventional liner might be jetted in this reverse sense which could reduce the weight of the needed explosive, and the explosive head height, to do the same damage. The method taught here could also tend to avoid the necessity of electronic communication e.g., wires between the front of the charge and the rear of the charge which may destroy the symmetry of the device.

4 Claims, 5 Drawing Sheets

SECTION I-I

SECTION I-I

REVERSE INITIATION DEVICE

This application is a continuation of application Ser. No. 6,754,892 filed Apr. 22, 1985, now abandoned.

GOVERNMENTAL INTEREST

The invention described herein may be manufactured, used and licensed by or for the Government for Governmental purposes without payment to me of any royalties thereon.

BACKGROUND AND FIELD OF THE INVENTION

Defeat of armor packages, especially of advanced, near impenetrable armored layers is a continuing problem. Development of ingenious shaped charges and arranging their sequences of jet initiations for defeating such armors, are continuing quests. A shaped-charge device involves detonating high explosive at the rear of a liner body and allowing sufficient distance of high explosive (head height) to form a plane detonation wave at the surface of such shaped-charge device. Conventional shaped-charge warheads currently utilize the single jet to defeat target. Reductions in head height without sacrificing performance are desirable, for smaller warhead size and weight results,and less explosive is needed leading to economies. While wave-shaping of the detonation wave, peripheral initiation and other techniques are employed to reduce head height a more satisfactory device is needed. Also, the art of penetrating the most advanced modern armors with particular sized jets, and sequences, is a continuing challenge. An improvement is postulated by jetting a larger slug at the target to form a crater, then following through with a thinner fast moving jet for inflicting more severe damage within the target, which might be for example the guidance system or seeker package in a missile. The standoff generated by the first crater could increase the destruction within; the second jet would see a thinner line-of-sight target thickness. In a missile configuration, in a further problem involving these types of warheads, the fuzing assembly is located at the front of the charge in the base region of the liner and electrical connections between the fuze and detonator must traverse the high explosive or body. The resulting explosive jet can be found limiting in the level of armor it can defeat especially advanced armor and elimination of this location for the fuzing assembly and electrical connections is clearly desirable. Clearly, any improvements in explosive weight and such factors discussed, and superior penetrability powers against advanced armors, would be most desirable.

SUMMARY OF THE INVENTION

A method of penetrating difficult armored targets by creating dual jet detonations in a reverse mode, having a thick massive jet followed by a thinner conical jet, is presented. I have discovered that when initiation is done at a base plane of a liner rather than at for example, the end of the charge, that it is possible to collapse a hemispherical equatorial region of a liner prior to a conical region at the pole of the hemisphere, thus creating a more massive jet followed by a thinner jet. I have also discovered that the massive jet followed by the thinner jet is superior for defeat of advanced armors, for I have observed that among other things, it opens a hole or crater and thus provides less material for the thinner jet to penetrate. The hemispherical liner surrounded by high explosive is detonated above, or symmetrically at, the equatorial (base) regions. Because the distances from the base liner regions are longer for the explosion to travel, the pole conical sections necessarily must collapse later than the equatorial region, rather than sooner as with an above pole, for example, initiation device if initiation were done at the pole. Inhibitor bodies are added in key places in the high explosive, in order to even further slow the detonation path down to the conical layer(at the polar areas) for its delayed detonation. Also single liners such as hemispheres without conical caps may be detonated in the reverse sense to reduce the explosive weight (head height) over polar initiation, and also to maintain the symmetry of the device.

OBJECTS

One object of this invention is to present an explosive device useful for defeating difficult advanced armor packages.

Another object of this invention is to present a shaped charge explosive device for generating a thick massive first jet of metal, followed by thinner penetrative jets.

A still further object of this invention is to create an improved shaped charge device of reduced head height and improved detonation wiring paths, for advanced deployment against difficult armor packages, to eliminate void regions in the high explosive or casing conventionally used to provide a wiring path which tend to destroy the symmetry of the device in detonation.

The foregoing and other objects and advantages of the invention will appear from the following description. In the description, reference is made to the accompanying drawings which form a part hereof, and in which there is shown by way of illustration and not of limitation, a preferred embodiment. Such description does not represent the full scope of the invention, but rather the invention may be employed in different arrangements according to the invention herein.

LIST OF FIGURES

DETAILED DESCRIPTION OF THE INVENTION

Figure 1:
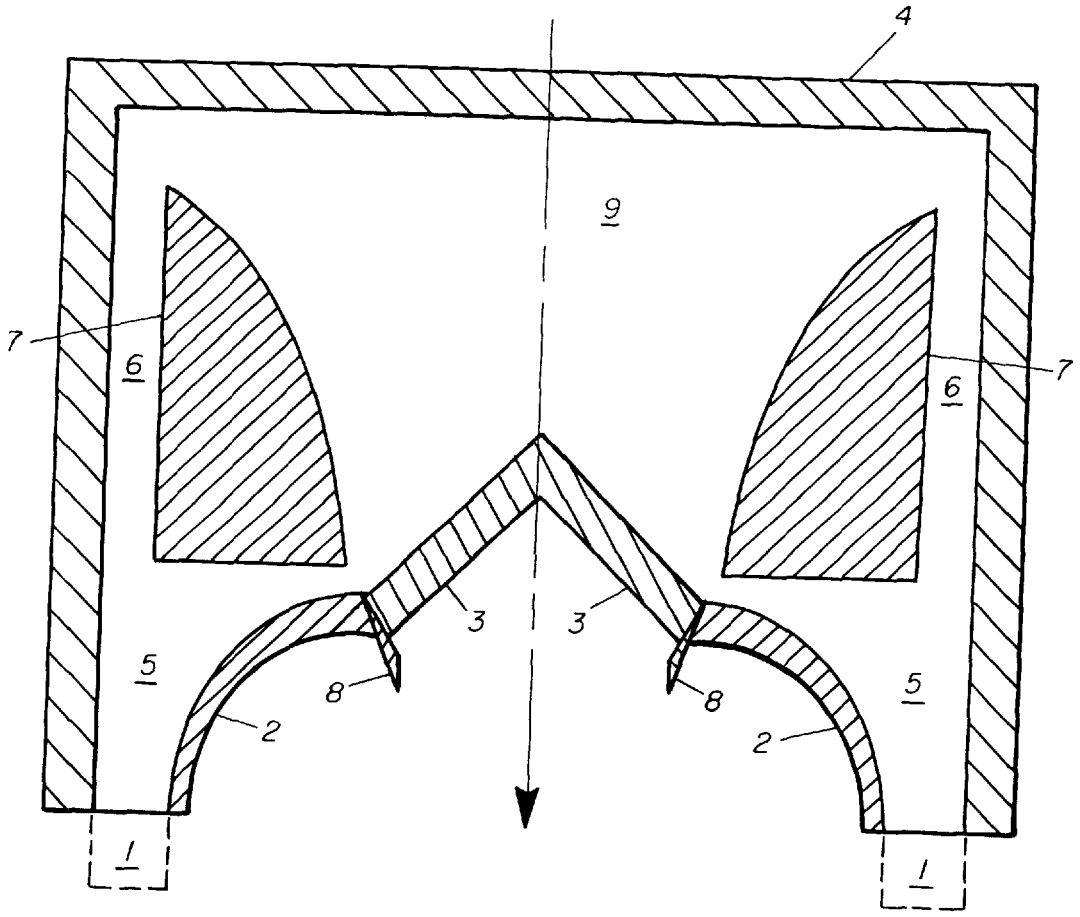
FIG. 1 shows an advanced reverse initiated shaped charge device according to this invention.

In FIG. 1, a shaped charge device suitable for the desired difficult armor penetration is illustrated. In this configuration, initiation is done at 1 peripherally, around the explosives at the base plane of the liner; shown by D, detonation at 1 can be of a variety of types.

In FIG. 1, the detonation wave will proceed from 5 into the region 6 which may contain an explosive with a lower detonation velocity than the HE of region 5. For example, OCTOL may be used in region 5 and PETN in region 6. The slower detonation velocity explosive 6, will allow additional time for the hemispherical liner 2 to collapse prior to the conical liner 3. If necessary, the length of region 6 can be altered to adjust the timing for this desired effect. The detonation wave from region 6 will peripherially initiate the HE 9 (same HE as 5) causing the collapse of the conical liner 3 in the conventional sense. The inhibitor 7 will prevent direct detonation of the HE 9. Also, the opening between regions 5 and 9 and between the metals 2 and 3 will be made sufficiently small to preclude predetonation of the HE 9 by 5 or leakage between metal parts 2 and 3. As an option, another inhibitor 8 may be inserted as indicated. The inhibitor 8 may also act as a slide plane for jetting the liner 2. The body 4 is used on the sides and rear of the device to assist in maintaining the detonation pressure to insure successful initiation. A heavy steel (¼") case may be required to prevent blow out of the HE 9 from the back surface before the liner 3 has collapsed. Successful operation of this shaped-charge device would allow the thicker, more massive hemispherical like jet (from 2) to precede the thinner conical jet (from 3). Since the thicker, hemispherical jet will travel slower than the thinner conical jet, a relatively short standoff-distance (top of cone to top of hemisphere) will be required to prevent the faster jet from overtaking the slower jet. The relative velocities of the two jets can be controlled by regulating the wall thicknesses of the two liners. In general, jets produced from thick wall liners travel slower than jets from thin wall liners. Also, the built-in standoff-distance is relatively short, usually about three charge diameters or less which allows sufficient distance of travel to prevent the faster jet from overtaking the slower jet. The first jet will form a hole or crater in the armor. The second (or primary) jet will follow through the hole made by the first jet and therefore be required to penetrate less armor and also it will strike the target at a greater travel distance, which enhances penetration when standoff-distance is greater, but when not beyond the peak standoff for ideal penetration by the warhead. The hemispherical-like liner in this invention does not even have to form a coherent jet. A near-spherical slug of high mass could sufficiently disrupt a target's armor enough to enhance the performance of the later arriving conical (primary) jet.

The detonation directly at the hemisphere base rather than above the liner polar region at the rear of the charge, the use of inhibitors and various degree high explosives and other innovations are concepts under the heading of "reverse initiation". While ordinarily one might expect the conical liner 3 to first collapse into a thin jet, surprisingly using the inventor's concepts it will later collapse; the reverse initiation will cause the detonation wave to proceed directly toward the base of the charge and initiate the collapse of the base (equatorial) region of the liner before initiating the collapse of the pole (or apex) region. Thus, the liner base will initiate its collapse before the pole, but the base elements have a greater distance of travel to the axis of symmetry (to begin the jetting process) than the pole elements. In this example, the liner wall thickness has been tapered to regulate the jet collapse velocity. The thinner wall configuration is intended to travel faster than a thicker even wall configuration. The ultimate ideal control of the liner collapse velocity would be for each element of the liner to reach the axis of symmetry of the charge with the same velocity and in sequential order, thus forming a uniform velocity, non-stretching, therefore, non-particulating rod.

Figure 2B:
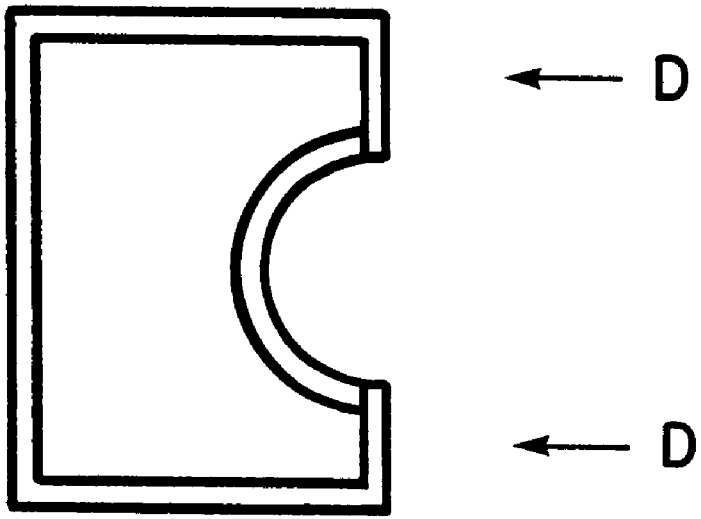
FIG. 2B shows a cylindrical block shaped charge in accordance with this invention.
Figure 2A:
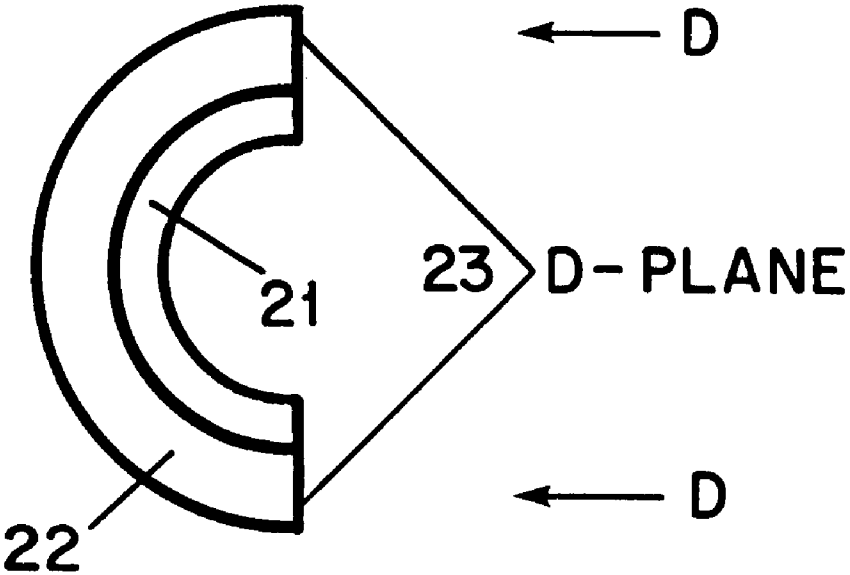
FIG. 2A shows a hemispherical liner shaped charge device according to this invention.
Figure 2D:
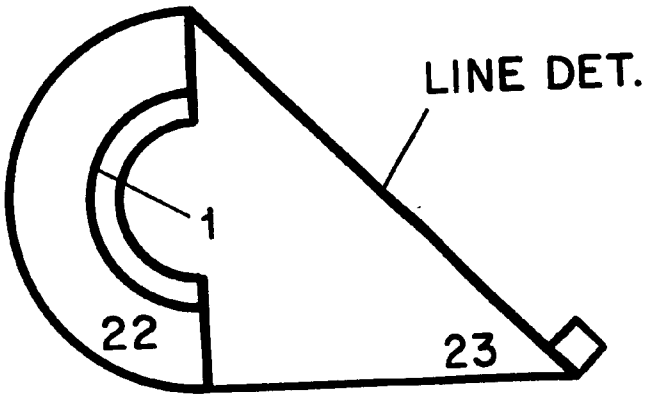
FIG. 2D shows a shaped charge device according to this invention wherein initiation is done by a triangular initiation sheet wrapped around the high explosive.
Figure 2C:
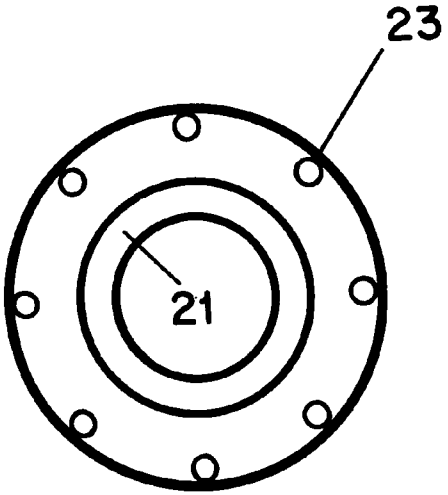
FIG. 2C shows a shaped charge device according to this invention wherein a series of detonators and boosters are positioned around the periphery of the high explosive elements.
Figure 2G:
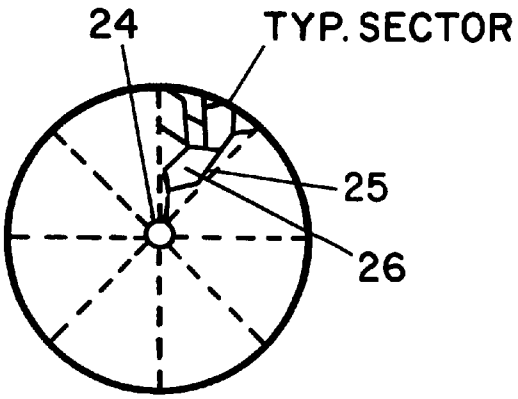
FIG. 2G shows an alternate design sectional view for FIG. 2E, along the same section line 1—1.
Figure 2F:
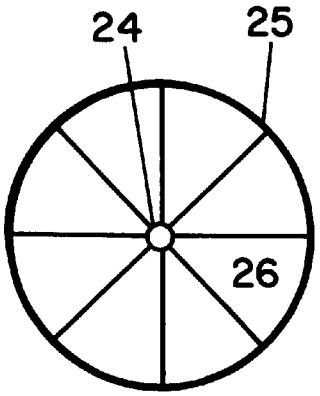
FIG. 2F shows a sectional view of FIG. 2E along the section lines 1—1.
Figure 2E:
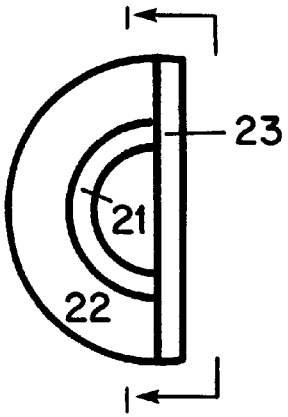
FIG. 2E shows a shaped charge device according to this invention wherein initiation is done using a plastic disk with center detonator and plural detonation paths arranged symmetrically as a hydra.

FIGS. 2A–2G illustrate other alternatives for embodying the reverse initiation of the liner of this invention. It will be recognized that there are many variations of inventions which fall within the inventor's concept for reverse initiation. In these examples, a shaped charge liner 21, (illustrated here as a hemispherical liner, although any existing shaped charge liner design is possible) is surrounded by a high explosive 22, either following the contour of the liner body as in FIG. 2A or as a cylindrical block as in FIG. 2B. FIG. 2B represents an excess of high explosive (HE) since the HE near the rear of the charge will not assist the collapse of the liner. The high explosive 22 is detonated at the base plane, 23, of the liner, using any of several conventional devices. For example, a series of detonators and boosters (8 or more) may be positioned around the periphery of the high explosive in a symmetric fashion as shown in FIG. 2C. Alternately, 8 or more prima cord leads could be channeled from the detonator/booster locations shown in FIG. 2C to a central location and initiated at one central point via a detonator/ booster arrangement. In FIG. 2D, the initiation of the high explosive 22 is achieved by a triangular section of DETASHEET™ wrapped around the periphery of 22 and detonated at the tip of the triangle, thus forming a line detonator. FIG. 2E employs a device utilizing a plastic disk with a detonator in the center and a series of HE trails imbedded in the plastic body such that the path the detonation wave travels in the HE (between the detonation point and the outer edge of the disk) is equal along every possible path. This device is termed a Hydra. FIG. 2F is a cross-section along Section 1—1 of FIG. 2E,and FIG. 2G is another design example shown by cross-section along Section 1—1. It has series of equal path lengths of high explosive in all sectors. In these examples, as was stated, reverse initiation will cause the detonation wave to proceed toward the base of the charge and initiate the collapse of the base or equatorial region of the liner before initiating the collapse of the pole or apex region. The shaped-charge dual jet of this invention would have distinct advantages over conventional single jets in that the larger jet would open a hole in the armor package of the target which the second jet could pass through unscathed. Thus, the second jet would see a thinner line-of-sight target thickness, but at a greater standoff. One should exercise care in the design of the hemispherical and conical liners, as well as the explosive geometry, to insure that the conical jet does not overtake the hemispherical jet prior to impact with the target.

Locating the detonator and booster near the fuzing assembly, as one further advantage of this invention i.e., in front or upstream of the liner, does not require any void regions in the high explosive or body which would destroy the symmetry of the shaped-charge device. It is also possible that the electronic reliability may be somewhat increased by shortening the amount of electrical wiring involved in the embodiment of this invention.

Figure 3:
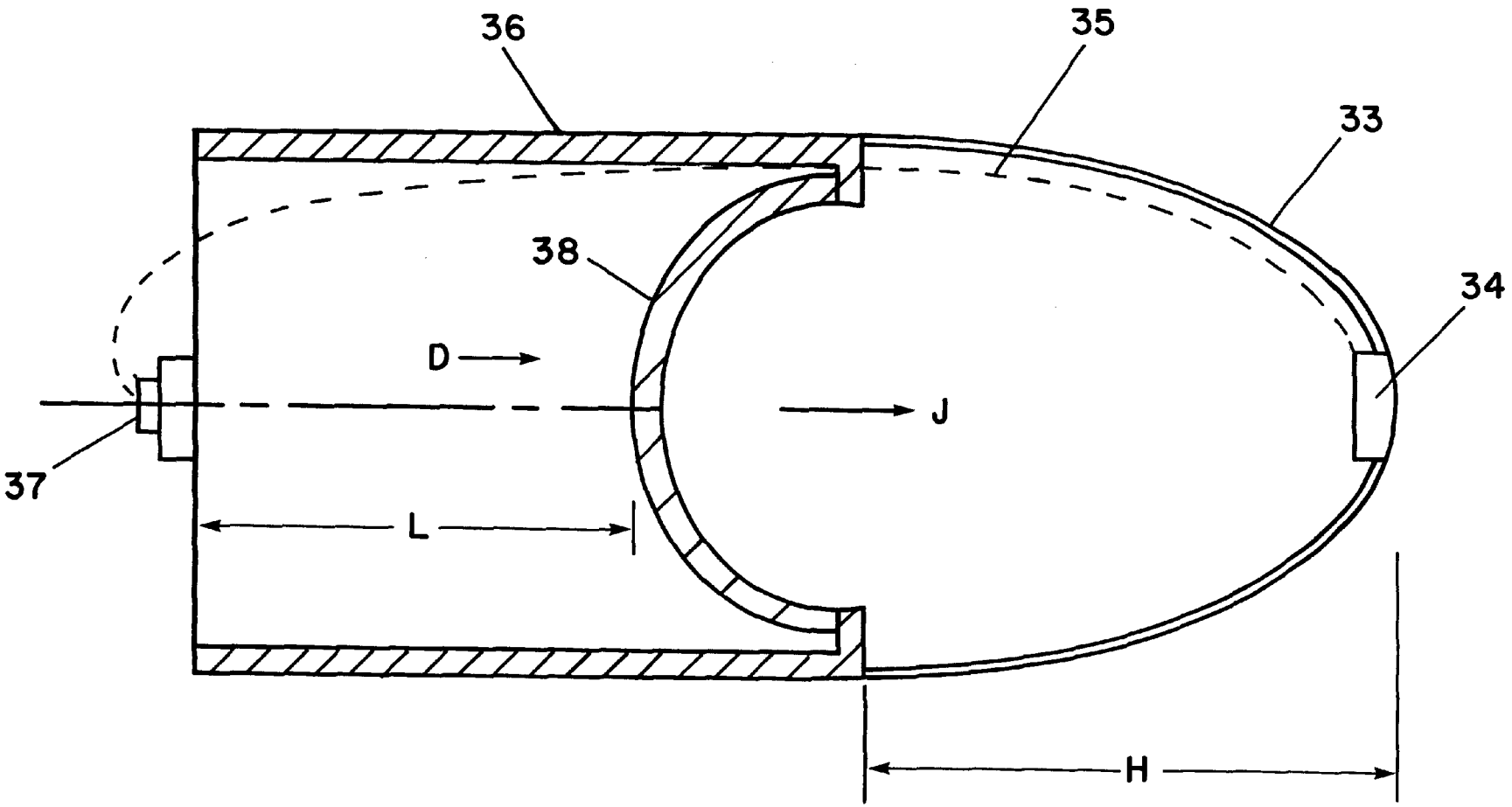
FIG. 3 shows the concept of standoff for initiation in a warhead.

FIG. 3 shows a shaped charge with an ogive. The fuzing assembly 34 at the front of the ogive provides a built-in standoff distance. Impact of the fuze in the ogive, precedes impact of the shaped charge, main device. The extra distance for the jet to travel is useful in defeating armor, for it has been found that about two shaped charge diameters or so, in extra standoff distance in front of a target, will increase penetration. The device of FIG. 1, described earlier above, in a sense, also works on a standoff principle. The initial large mass penetrates some distance into the armor. The real destroyer is the thin jet that won't hit the target until it also goes down into the crater created by the large mass, which is a "standoff" distance further than usual, in a sense but may be advantageous.

While the invention has been described with reference to one particular embodiment or embodiments, the invention also includes all variations, substitutions and modifications as will be obvious to those skilled in the art within the spirit and scope of the invention, its description or claims.

What is claimed is:

1. An explosive device for defeating a plate of armor, comprising:

body for enclosing an area of high explosive, said body having one open end; arcuate shaped charge liner in said open end, said liner shaped as a hemispherical section having a conical cap on its polar region, being concave in the open end direction;

annular slide plane means between said cap and said hemispherical section;

high explosive essentially filling the region within said body bounded by the liner;

detonation means proximate said hemispherical section, within the high explosive;

inhibitor means in said high explosive above said conical cap of said shaped liner.

2. A device as in claim 1 wherein the region at the base and immediately surrounding the hemisphere is filled with a first high explosive, the regions annularly around said inhibitor, outwardly, are filled with a second explosive, and the regions within the bounds of said inhibitor and above the conical section are filled with a third explosive, wherein the said first explosive has a higher detonation velocity than the said second explosive.

3. A device as in claim 2 wherein the said slide plane is also of an inhibitor material.

4. A device as in claim 2 wherein the first and third explosives are OCTOL and the second explosive is PETN.

* * * * *